US005952774A

United States Patent [19]

Diven et al.

[11] Patent Number: 5,952,774

[45] Date of Patent: Sep. 14, 1999

[54] COLOR CRT HAVING A SUPPORT FRAME ASSEMBLY WITH DETENSIONING MEANS

[75] Inventors: Gary Lee Diven; Frank Rowland Ragland, Jr., both of Lancaster, Pa.

[73] Assignee: Thomson Consumer Electronics, Inc., Indianapolis, Ind.

[21] Appl. No.: 08/844,366

[22] Filed: Apr. 18, 1997

[51] Int. Cl.[6] ..... H01J 29/07

[52] U.S. Cl. ..... 313/402; 313/404; 313/405; 313/407

[58] Field of Search ..... 313/402–408

[56] References Cited

U.S. PATENT DOCUMENTS

| | | | |
|---|---|---|---|
| 5,111,107 | 5/1992 | Kume et al. | 313/405 |
| 5,594,300 | 1/1997 | Nosker et al. | 313/402 |
| 5,644,192 | 7/1997 | Ragland, Jr. | 313/402 |

*Primary Examiner*—Vip Patel
*Assistant Examiner*—Matthew J. Gerike
*Attorney, Agent, or Firm*—Joseph S. Tripoli; Dennis H. Irlbeck

[57] ABSTRACT

The present invention provides an improvement in a CRT (10) having a tension mask (24) and support frame assembly (35). The support frame assembly (35) is rectangular and has two long sides that parallel a central major axis thereof and two short sides that parallel a central minor axis thereof The mask (24) has a substantially cylindrical contour, being curved along the major axis and straight along the minor axis. The frame assembly (35) includes two first members (36, 38; 136, 138) that parallel the major axis and two second members (40, 42), attached to the ends of the first members, that parallel the minor axis. Each of the first members (36, 38; 136, 138) includes a rigid section (50; 150) and a compliant section (52; 152) cantilevered from the rigid section (50; 150). The compliant sections (52; 152) have a distal end (54; 154) and a proximal end (56; 156). The mask (24) is attached to the distal ends (54; 154) of the compliant sections (52; 152). The improvement comprises at least one of the compliant sections (52; 152) including an alloy portion (60; 160, 161) and a bimetal portion (58; 158) for relaxing the tension on the strands (32) of the mask (24) when subjected to an elevated temperature and restoring the tension on the strands (32) of the mask (24) at a temperature below the elevated temperature.

8 Claims, 3 Drawing Sheets

COLOR CRT HAVING A SUPPORT FRAME ASSEMBLY WITH DETENSIONING MEANS

The invention relates to color cathode-ray tubes (CRT's), such as color picture tubes (CPT's) and color display tubes (CDT's), having tension masks attached to support frame assemblies, and particularly to tubes with support frame assemblies having a tension mask that is attached to a compliant support frame having detensioning means.

BACKGROUND OF THE INVENTION

A color cathode-ray tube (CRT) includes an electron gun for generating and directing three electron beams to a screen of the tube. The screen is located on the inner surface of a cylindrical faceplate of the tube and is made up of an array of elements of three different color emitting phosphors. An apertured mask, such as a tension mask, is interposed between the gun and the screen to permit each electron beam to strike only the phosphor elements associated with that beam. A tension mask is a thin sheet of metal, such as steel, that is contoured to somewhat parallel the inner surface of the cylindrical faceplate of the tube. The tension mask generally comprises parallel strands of wire attached to a relatively massive support frame which maintains tension on the strands. Another type of CRT has a tensioned focus mask comprising dual sets of conductive strands that are perpendicular to each other and usually separated by an insulative layer.

In either type of CRT it is necessary that the strands of the tension mask are attached to the support frame, and that the tension be maintained during operation of the tube. A drawback of prior support frames is that during the thermal processing cycle, in which the faceplate panel is sealed to the funnel of the tube, the sealing temperature, which is in the range of about 440–460° C., causes a permanent elongation, or "creep" of the mask strands which lowers the tension in the strands during normal tube operation. High strand tension during operation is desirable for good microphonic performance and to absorb the thermal expansion of the strands due to heating by the electron beam during normal operation. The heating during normal operation generally raises the temperature of the tension mask to less than about 65° C.

U.S. Pat. No. 5,594,300, issued to Nosker et al., on Jan. 14, 1997, describes a CRT having a tension mask and compliant support frame assembly. The support frame members include two portions that parallel the major axis of the CRT and two portions that parallel the minor axis. Each portion that parallels the major axis includes a rigid section and a compliant section that is cantilevered from the rigid section. The cantilevered sections maintain the tension on the mask strands. Although such a structure is an improvement over more massive frame structures and reduces the weight and cost of the frame assembly, there is still a need for further improvement in CRT types having a cylindrical faceplate, to improve the performance of the frame assembly during all phases of tube processing and operation.

SUMMARY OF THE INVENTION

In accordance with the invention, a CRT has a tension mask and an improved support frame assembly. The support frame assembly is rectangular and has two long sides that parallel a central major axis thereof and two short sides that parallel a central minor axis thereof The mask has a substantially cylindrical contour, being curved along one of the axes. The support frame assembly includes two first members that parallel the major axis and two second members, attached to the ends of the first members, that parallel the minor axis. Each of the first members includes a rigid section and a compliant section cantilevered from the rigid section. The compliant sections each have a distal end and a proximal end. The mask is attached between the distal ends of the compliant sections. The improvement comprises at least one of the compliant sections of the first members including a portion for detensioning the mask when subjected to an elevated temperature and restoring the tension on the mask at a temperature below the elevated temperature.

DETAILED DESCRIPTION OF THE PREFERRED EMBODIMENTS

Figure 1:
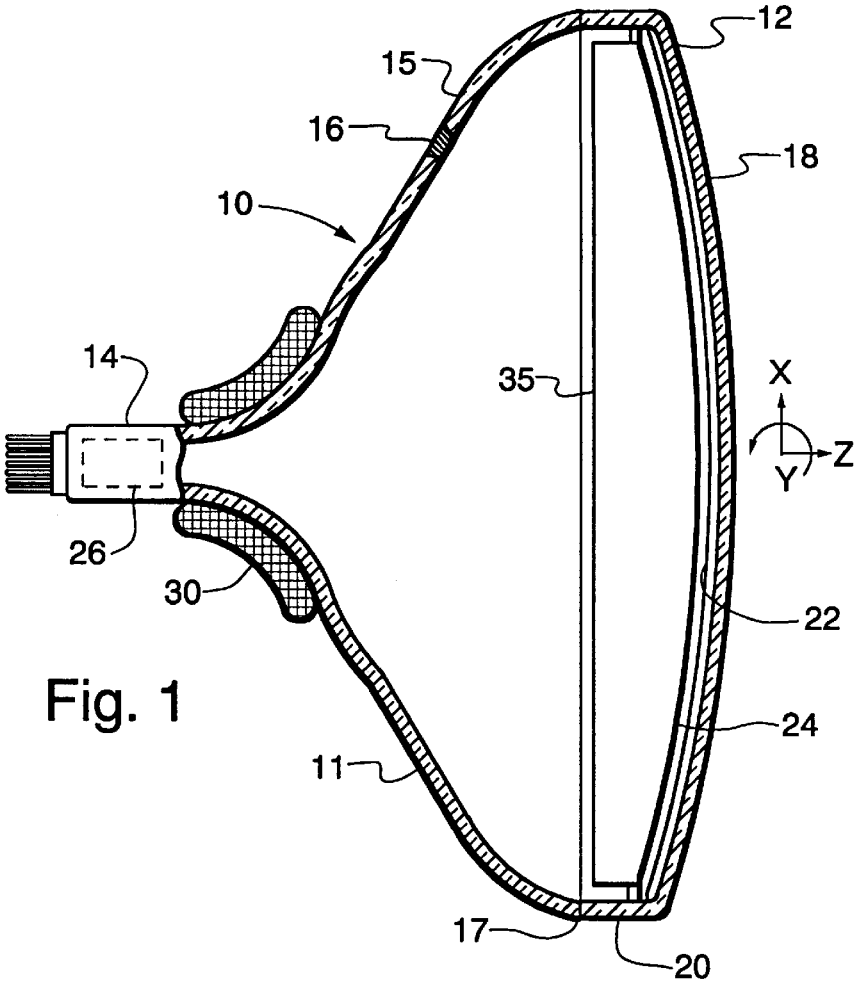
FIG. 1 is a top view, partially in axial section, of a CRT embodying the invention.

FIG. 1 shows a CRT 10 having a glass envelope 11 comprising a rectangular faceplate panel 12 and a tubular neck 14 connected by a rectangular funnel 15. The funnel has an internal conductive coating (not shown) that extends from an anode button 16 to the neck 14. The panel 12 comprises a substantially cylindrical viewing faceplate 18 and a peripheral flange or sidewall 20, which is sealed to the funnel 15 by a glass frit 17. A three-color phosphor screen 22 is carried on the inner surface of the faceplate 18. The screen 22 is a line screen with the phosphor lines arranged in triads, each triad including a phosphor line of each of the three colors. A substantially cylindrical multi-apertured color selection electrode or tension mask 24 is removably mounted in predetermined spaced relation to the screen 22. The color selection electrode or tension mask 24 may be either a tension mask or a tension focus mask. An electron gun 26, shown schematically by dashed lines in FIG. 1 is centrally mounted within the neck 14 to generate and direct three inline beams, not shown, along convergent paths through the mask 24 to the screen 22.

The CRT 10 is designed to be used with an external magnetic deflection yoke, such as the yoke 30, shown in the neighborhood of the funnel-to-neck junction. When activated, the yoke 30 subjects the three beams to magnetic fields which cause the beams to scan horizontally and vertically in a rectangular raster over the screen 22.

Figure 2:
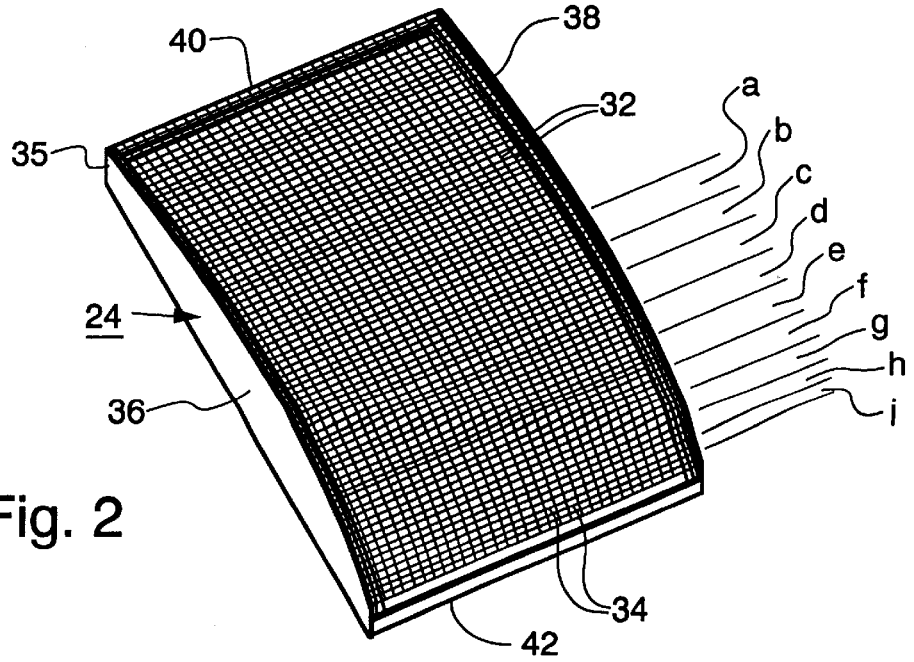
FIG. 2 is a perspective view of a tension focus mask and support frame assembly.
Figure 3:
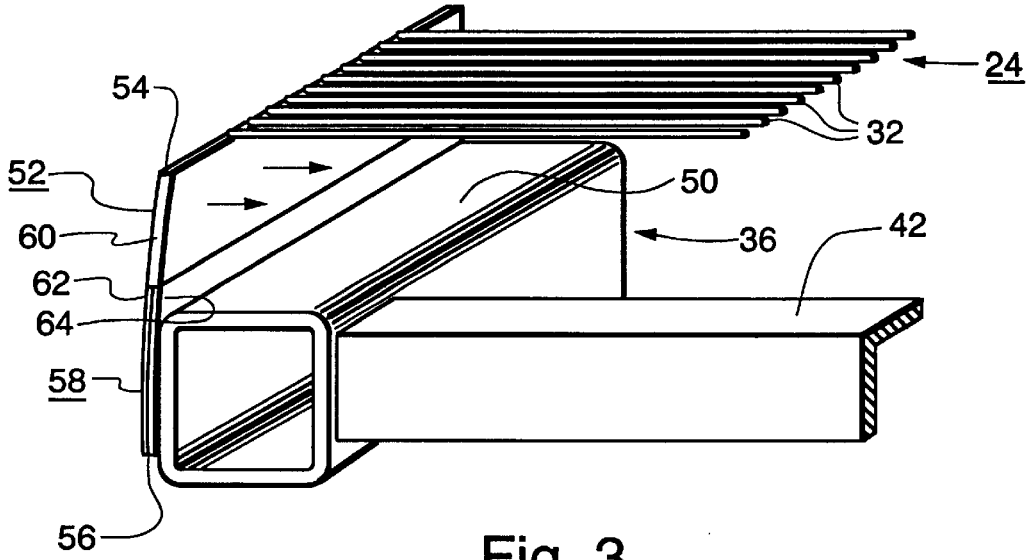
FIG. 3 is a partial perspective view of a first embodiment of a tension mask and support frame assembly according to the present invention.

The tension mask, shown as a tension focus mask 24 in FIG. 2, includes a plurality of metal strands 32 and cross wires 34 that are insulated from the metal strands. The support frame assembly 35 is substantially rectangular and includes two long sides comprising first members 36 and 38 paralleling the major axis, and two short sides comprising second members 40 and 42 attached to the ends of the first members and paralleling the minor axis. The tension focus mask 24 has a substantially cylindrical contour, being curved along the major axis and straight along the minor axis. As shown in FIG. 3, the first members 36 has a rigid section 50 and a compliant section 52 that includes a distal end 54 and a proximal end 56. The proximal end 56 is secured to the rigid section 50 and the distal end 54 is cantilevered therefrom. An identical structure, not shown, comprises the opposing first member 38. The strands 32 of the mask 34 are attached between the distal ends 54 of the compliant sections 52, only one of which is shown in FIG. 3. As thus far described, the tension mask 24 and support frame assembly 35 are identical to the structure described in U.S. Pat. No. 5,594,300, referenced above.

Figure 4:
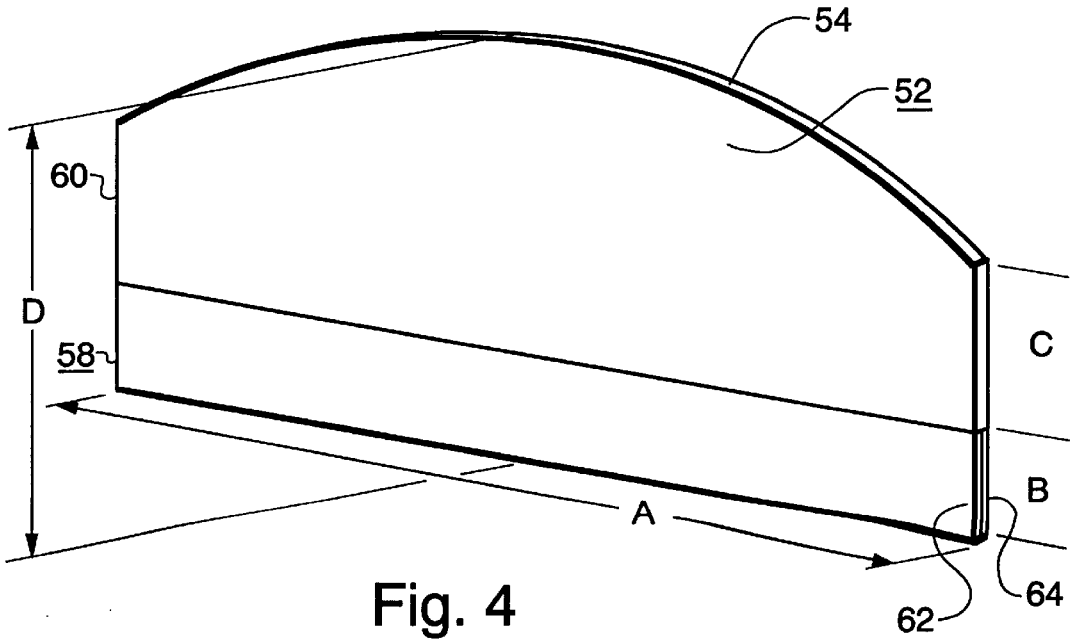
FIG. 4 is a perspective view of a compliant section of the support frame assembly of FIG. 3.

A first embodiment of the present invention differs from that of U.S. Pat. No. 5,594,300 in that the compliant sections 52 of the present invention provide a means for detensioning the strands 32 of the mask 24 during frit sealing of the faceplate panel 12 to the funnel 15. In this first embodiment of the invention, shown in FIGS. 3 and 4, the compliant section 52 includes a bimetal portion 58 and an alloy portion 60. The bimetal portion 58 of the compliant section 52 is attached to the rigid section 50 of at least one of the first members, such as first member 36. Alternatively, each of the compliant sections 52 may include a bimetal portion 58. The bimetal portion 58 includes a high expansion first metal layer 62 joined in face-to-face relation to a low expansion second metal layer 64. As the temperature increases during frit sealing, to an ultimate sealing temperature within the range of about 440–460° C., the higher expansion of the first metal layer 62 causes the compliant section 52 to bend inwardly, in the direction of the arrows in FIG. 3, to relieve the tension on the strands 32 of the tension focus mask 24.

In this first preferred embodiment for a CRT 10 having a diagonal dimension of 68 cm, the bimetal portion 58 of the compliant section 52 has a length, A, of about 51.91 cm and a height, B, of about 1.91 cm. The bimetal is available as type 2500, from Chase Precision Metals, Inc., of Reidsville, N.C. The alloy portion 60 of the compliant section 52 is formed of 1008 steel and has a height, C, at the outer edge of about 2.92 cm. The overall height, D, of the compliant section 52, at the center, is about 7,39 cm. The distal end 54 of the alloy portion 60 has a radius of curvature of 130 cm.

Figure 5:
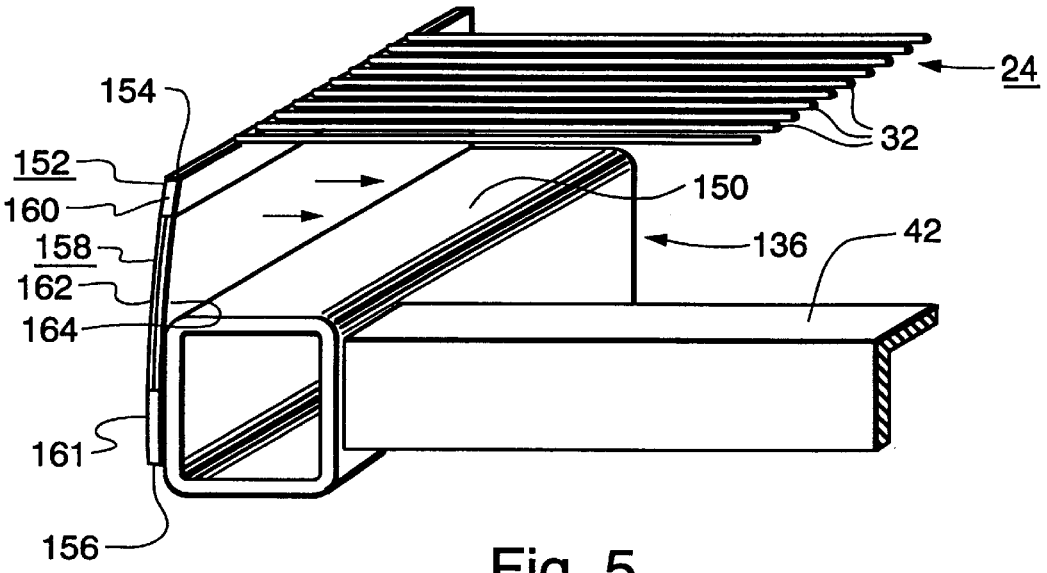
FIG. 5 is a partial perspective view of a second embodiment of a tension mask and support frame assembly according to the present invention.
Figure 6:
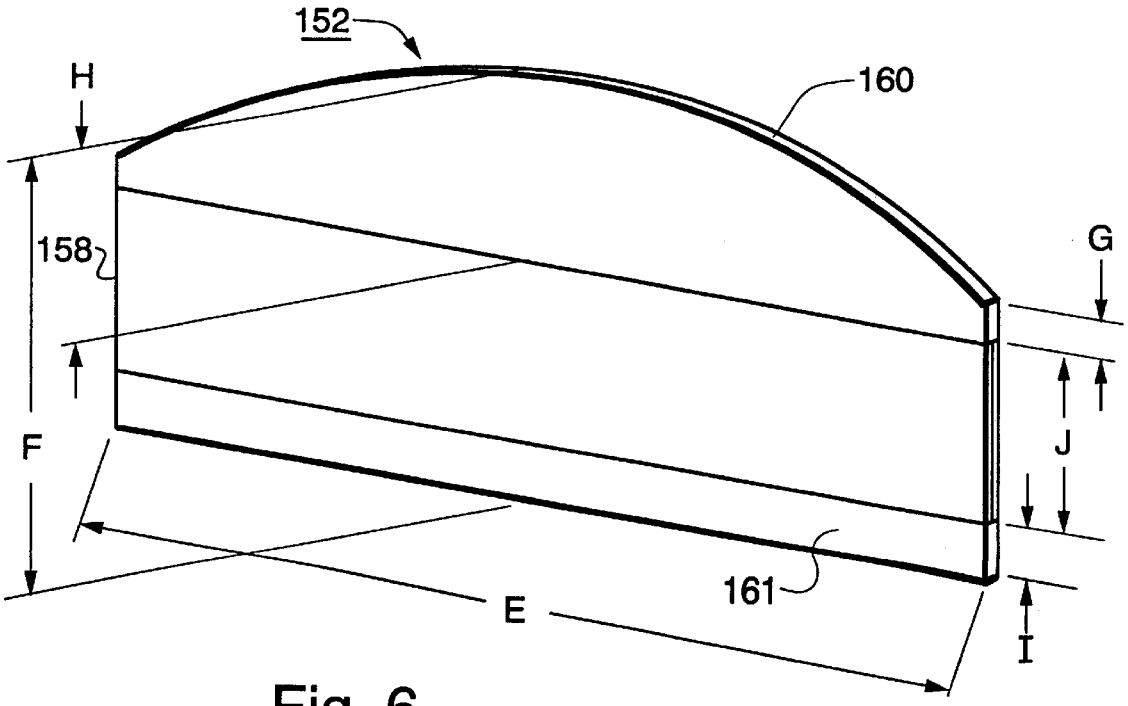
FIG. 6 is a perspective view of a compliant section of the support frame assembly of FIG. 5.

In the second embodiment of the invention, shown in FIGS. 5 and 6, at least one compliant section 152 includes a bimetal portion 158, a first alloy portion 160 and a second alloy portion 161. The bimetal portion 158 is disposed between the first and second alloy portions and attached thereto. The proximal end 156 of each compliant member 152 is attached to the rigid section 150 of the first members 136, 138; however, only the first member 136 is shown in FIG. 5. Alternatively, each of the compliant members 152 may include a bimetal portion 158. The bimetal portion 158 includes a high expansion first metal layer 162 joined in face-to-face relation to a low expansion second metal layer 164. As the temperature increases during frit sealing, to an sealing temperature within the range of about 440–460° C., the higher expansion of the first metal layer 162 causes the compliant section 152 to bend inwardly, in the direction of the arrows in FIG. 5, to relieve the tension on the strands 32 of the tension focus mask 24 which are attached between the distal end 154 of the compliant section. In the second preferred embodiment, the compliant section 152 has a length, E, of about 51.91 cm and an overall height, F, of about 2.92 cm. The first alloy portion 160 has a length equal to that of the compliant section 152 and a height, at the edge of about 0.58 cm. The height, H, at the center of the alloy portion 160 is about 3.15 cm. The second alloy portion 161 also has a length equal to that of the compliant section 152 and a height, I, of about 1.09 cm The bimetal section 158 also is formed of type 2500 bimetal and is available from Chase Precision Metals, Inc. The bimetal section 158 has a length equal to that of the compliant section 152 and has a height, J, of about 3.15 cm.

TABLE 1 lists the tension in the mask strands 32, within the various positions on the mask, at a room temperature of 23° C., for the first and second embodiments of the invention. Location, a, is measured from the center of the mask outwardly, in both TABLES 1 and 2. TABLE 2 lists the tension in the mask strands, within the various locations, at an elevated temperature of about 425° C. for the first and second embodiments of the invention. The locations a–i listed in the TABLES are shown in FIG. 2.

TABLE 1

| Location | Dimension cm | Tension @ 23° C. Kg $cm^{-2}$ |
|---|---|---|
| a | 4.38 | 843.9–1023.5 |
| b | 3.81 | 1023.5–1203.1 |
| c | 2.67 | 1203.1–1382.7 |
| d | 2.29 | 1382.7–1562.4 |
| e | 1.91 | 1562.4–1742.0 |
| f | 1.90 | 1742.0–1921.6 |
| g | 1.52 | 1921.6–2101.2 |
| h | 1.91 | 2101.2–2280.8 |
| i | 1.14 | 2280.8–2461.5 |

TABLE 2

| Location | Dimension cm | Tension @ 425° C. Kg $cm^{-2}$ |
|---|---|---|
| a | 4.19 | 0–44.0 |
| b | 2.29 | 44.0–88.0 |
| c | 2.29 | 88.0–132.0 |
| d | 1.91 | 132.0–176.0 |
| e | 2.29 | 176.0–220.1 |
| f | 1.91 | 220.1–264.1 |
| g | 1.90 | 264.1–308.2 |
| h | 1.52 | 308.2–352.2 |
| i | 3.05 | 352.2–396.2 |

What is claimed is:

1. In a color cathode-ray tube having a tension mask and a support frame assembly, said support frame assembly being rectangular and having two long sides paralleling a central major axis thereof and two short sides paralleling a central minor axis thereof, said tension mask comprising a plurality of strands, said mask having a substantially cylindrical contour, being curved along said major axis and straight along said minor axis, said frame assembly including two first members paralleling said major axis and two second members, attached to the ends of said first members, paralleling said minor axis, each of said first members having a rigid section and a compliant section including a distal end and a proximal end, said proximal end being cantilevered from said rigid section, and mask being attached to each distal end of said compliant sections, the improvement comprising, at least one of said compliant sections including an alloy portion and a bimetal portion for relaxing the tension on said strands of said mask when subjected to an elevated temperature and restoring the tension on said strands of said mask at a temperature below said elevated temperature.

2. The color cathode-ray tube as defined in claim 1, wherein the height of said alloy portion of said compliant section varies from the center to the ends thereof and said bimetal portion is of substantially uniform length and width.

3. The color cathode-ray tube as defined in claim 2, wherein said bimetal portion of said compliant section is a face-to-face bimetal.

4. The color cathode-ray tube as defined in claim 3, wherein said bimetal portion comprises type 2500 metal.

5. The color cathode-ray tube as defined in claim 2, wherein at least one of said compliant sections includes a first and a second alloy portion attached to said bimetal portion.

6. The color cathode-ray tube as defined in claim 5, wherein said first alloy portion varies in height from the center to the ends thereof, said second alloy portion is of substantially uniform length and width and is attached to said rigid section of said frame, and said bimetal portion is of substantially uniform length and width.

7. The color cathode-ray tube as defined in claim 6, wherein said first and second alloy portions are made of 1008 alloy.

8. The color cathode-ray tube as defined in claim 1, wherein said tension mask is a focus mask having a plurality of cross wires substantially perpendicular to said strands and insulated therefrom.

* * * * *